US009868309B2

(12) United States Patent
Chng et al.

(10) Patent No.: US 9,868,309 B2
(45) **Date of Patent: *Jan. 16, 2018**

(54) PRINT CARTRIDGES WITH ONE-PIECE PRINTHEAD SUPPORTS

(71) Applicant: HEWLETT-PACKARD DEVELOPMENT COMPANY, L.P., Houston, TX (US)

(72) Inventors: Kiong Chin Chng, Singapore (SG); Djuhartini Tandjo, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/589,375

(22) Filed: May 8, 2017

(65) Prior Publication Data

US 2017/0239965 A1 Aug. 24, 2017

Related U.S. Application Data

(63) Continuation of application No. 15/022,156, filed as application No. PCT/US2013/061511 on Sep. 25, 2013, now Pat. No. 9,676,189.

(51) Int. Cl.

| | |
|---|---|
| ***B41J 25/34*** | (2006.01) |
| ***B41J 2/175*** | (2006.01) |
| ***B41J 2/16*** | (2006.01) |

(52) U.S. Cl.

CPC ..... *B41J 25/34* (2013.01); *B41J 2/162* (2013.01); *B41J 2/1637* (2013.01); *B41J 2/17503* (2013.01)

(58) Field of Classification Search

CPC . B41J 2/175; B41J 2/1433; B41J 25/34; B41J 2/1637; B41J 2/162

See application file for complete search history.

(56) References Cited

U.S. PATENT DOCUMENTS

| | | | | |
|---|---|---|---|---|
| 5,469,199 | A | 11/1995 | Allen | |
| 5,751,323 | A | 5/1998 | Swanson et al. | |
| 5,903,295 | A | 5/1999 | Swanson et al. | |
| 5,924,198 | A | 7/1999 | Swanson et al. | |
| 6,749,287 | B2 * | 6/2004 | Osada | B41J 2/14024 347/49 |
| 6,830,315 | B2 | 12/2004 | Silverbrook et al. | |
| 6,942,316 | B2 | 9/2005 | Scheffelin et al. | |
| 7,093,926 | B2 | 8/2006 | Gil | |
| 7,758,163 | B2 | 7/2010 | Petersen et al. | |
| 8,057,023 | B2 | 11/2011 | Silverbrook | |
| 2003/0052944 | A1 | 3/2003 | Scheffelin et al. | |
| 2012/0086764 | A1 | 4/2012 | Golda et al. | |
| 2012/0274705 | A1 | 11/2012 | Petersen et al. | |

OTHER PUBLICATIONS

International Search Report and Written Opinion for International Application No. PCT/US2013/061511 dated Jun. 25, 2014, 12 pages.

* cited by examiner

*Primary Examiner* — Thinh H Nguyen

(74) *Attorney, Agent, or Firm* — HP Inc. Patent Department

(57) ABSTRACT

In some examples, a print cartridge includes a housing, a one-piece printhead support attached to the housing, a printhead supported on a head-land surface area, and a trench in the printhead support surrounding the head-land surface area on at least two sides.

20 Claims, 4 Drawing Sheets

PRINT CARTRIDGES WITH ONE-PIECE PRINTHEAD SUPPORTS

CROSS REFERENCE TO RELATED APPLICATION

This is a continuation of U.S. application Ser. No. 15/022,156, filed Mar. 15, 2016, which is a national stage application under 35 U.S.C. §371 of PCT/US2013/061511, filed Sep. 25, 2013, which are both hereby incorporated by reference in their entirety.

BACKGROUND

Conventional inkjet print cartridges, or pens, include a printhead assembly and ink supply assembly integrated within a monolithic housing that simplifies the replacement of ink supplies for inkjet printers. The printhead assembly supports a printhead die adhered to a carrier substrate, or chiclet. Thus, the chiclet serves as a printhead die support platform as well as a fluid distribution manifold to distribute ink from the ink supply assembly to ink feed slots in the die. In general, the chiclet is adhered to a base component, which in turn, is adhered to a housing of the ink supply assembly. Because the chiclet serves as a support platform for the printhead die, it is important that the surface planarity at the top of the chiclet with respect to the planarity of the base is maintained. However, the chiclet, the base, and other assembly components, each have six degrees of freedom in free space, which presents a significant challenge when trying to properly align and adhere these components to one another during fabrication. In addition, the chiclet and base are typically made of different plastic materials that have different coefficients of thermal expansion. Therefore, thermal excursions encountered during fabrication, testing, and shipping, create stresses between the chiclet and base that in turn can stress and fracture the printhead die adhered to the chiclet.

BRIEF DESCRIPTION OF THE DRAWINGS

The present embodiments will now be described, by way of example, with reference to the accompanying drawings, in which.

DETAILED DESCRIPTION

Overview

Figure 1:
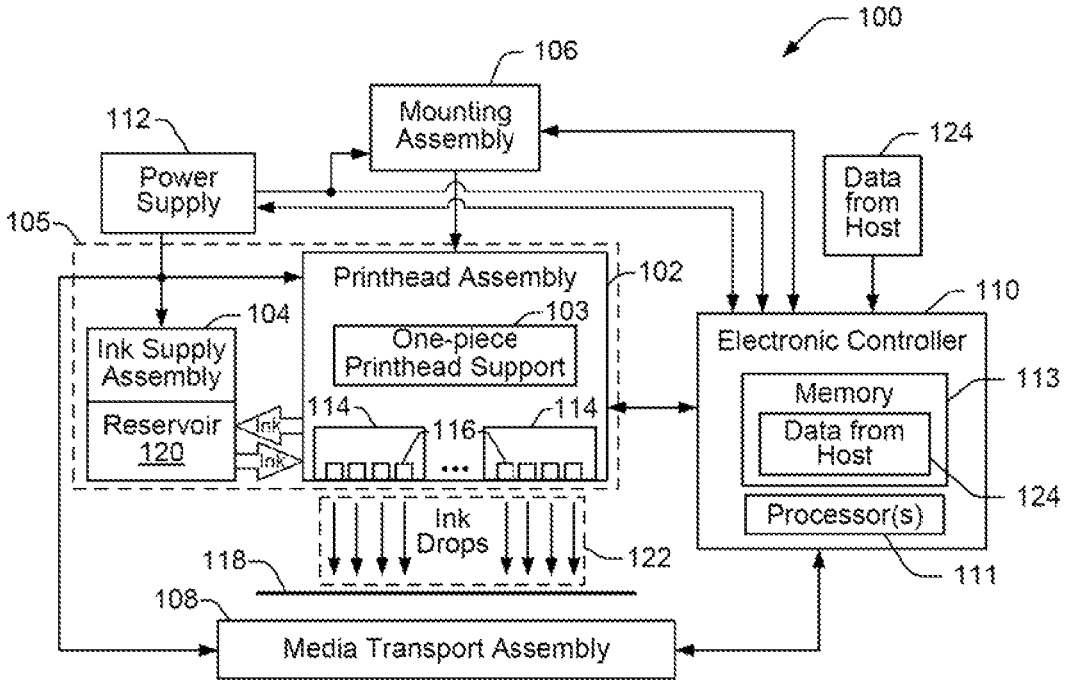
FIG. 1 illustrates an example of a fluid ejection system implemented as an inkjet printing system.

As noted above, the fabrication of printhead assemblies in conventional inkjet print cartridges involves a challenging task of joining together (e.g., by adhesion) various components that support a printhead die and facilitate the flow of ink to the die from an ink supply assembly. In particular, the process of adhering a die carrier substrate, or chiclet, to a base component can result in inaccurate orientation between the components and poor surface planarity in the head-land area of the chiclet where the printhead die is to be mounted. Maintaining the planarity of the chiclet with respect to the planarity of the base is important as it helps avoid print quality problems and other issues associated with the resulting orientation of the printhead die to the print media. In general, the position in free space of a rigid body, such as the chiclet and base components in the printhead assembly, is defined by six degrees of freedom. More specifically, the position of each printhead assembly component is defined by three degrees of translation based on its location within an xyz plane, and three degrees of rotation based on its forward, backward, and lateral rotation. Thus, for any two components that are to be adhered to one another within the printhead assembly, there are twelve degrees of freedom between their relative positions. This variability in the freedom of movement between the chiclet and base components complicates the process of joining the components together (e.g., by adhesion) within the printhead assembly, reducing yields and adding cost to the fabrication of the print cartridge.

In addition to orientation issues associated with joining the printhead assembly components, differences in the material makeup of the joined components can cause problems in the printhead assembly such as a failure of the printhead die. In particular, the chiclet and the base are formed from different materials (e.g., plastics) that have different coefficients of thermal expansion (CTEs). Therefore, the chiclet and the base expand and contract at different rates and in different amounts during thermal cycling events. Thermal cycling is often encountered, for example, during fabrication, testing, and/or shipping of the print cartridge. Variations in the way the chiclet and base expand and contract through thermal excursions creates mechanical stress in the head-land area of the adhered chiclet and base. This stress can cause cracks in the silicon printhead die, leading to a failure of the printhead assembly.

Example implementations of a printhead assembly discussed herein include a molded, one-piece printhead support that eliminates inaccuracies in orientation between a chiclet (i.e., a printhead die carrier substrate) and a base component. A two-shot molding process unites a carrier substrate portion and a base portion into a single component that forms the one-piece printhead support. The two-shot molding process simplifies the printhead assembly fabrication in part, by eliminating the twelve degrees of freedom that would otherwise be present between separate chiclet and base components, which eliminates the challenges associated with accurately orienting and joining separate components to each other. The molded, one-piece support provides a consistently planar head-land surface area for supporting the printhead die, and serves as a fluid distribution manifold to distribute ink from the ink supply assembly to the ink feed slots in the printhead die.

In addition to eliminating orientation inaccuracies between a chiclet (die carrier substrate) and base, the molded, one-piece printhead support helps to prevent cracking of the adhered printhead die through a trench formed in the printhead support. The trench comprises a two-, three-, or four-sided trench that surrounds a head-land area of the support on two, three, and four sides, respectively. When the trench is a three-sided trench, it results in a peninsula-shaped head-land surface area on the printhead support to which the die is adhered. The trench serves as a buffer zone or space barrier around the head-land area and the printhead die that reduces mechanical stress in the head-land area generally caused by material expansion and contraction of the one-piece printhead support during temperature excursions. The reduction in mechanical stress over the head-land surface area to which the printhead die is attached, helps prevent cracks in the die.

In one example, a printhead assembly includes a one-piece printhead support. A printhead is supported on a head-land surface area of the printhead support, and a trench in the printhead support surrounds the head-land surface area on a number of sides.

In another example, a printhead assembly includes a one-piece printhead support attached at a bottom side surface to a housing. A printhead die is supported by a head-land area of the printhead support, and fluid channels in the head-land area are to supply fluid to the printhead die. Fluid inlets at the bottom side surface are fluidically coupled with the fluid channels through the printhead support, and the fluid inlets are in fluid communication with a fluid reservoir within the housing.

In another example, a printhead assembly includes a one-piece printhead support having a chiclet portion and a base portion that are molded together in a two-shot molding process. The printhead assembly also includes a peninsular-shaped head-land area on the chiclet portion and a printhead die supported on the head-land area.

Illustrative Embodiments

FIG. 1 illustrates a fluid ejection system implemented as an inkjet printing system 100, according to an example implementation. Inkjet printing system 100 generally includes an inkjet printhead assembly 102, an ink supply assembly 104, a mounting assembly 106, a media transport assembly 108, an electronic controller 110, and at least one power supply 112 that provides power to the various electrical components of inkjet printing system 100. In this example, fluid ejection devices 114 are implemented as fluid drop jetting printheads 114 (e.g., inkjet printheads 114). A fluid drop jetting printhead 114 may be variously referred to herein as a fluid ejection device 114, an inkjet printhead 114, a printhead 114, a silicon printhead die 114, a printhead die 114, a die 114, or other similar variations thereof. Inkjet printhead assembly 102 includes at least one fluid drop jetting printhead die 114 that ejects drops of ink through a plurality of orifices or nozzles 116 toward print media 118 so as to print onto the print media 118. Nozzles 116 formed in a nozzle plate, or nozzle layer, are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As discussed further below, printhead assembly 102 also includes a molded, one-piece printhead support 103 to support the printhead die 114.

In some examples, inkjet printing system 100 is a drop-on-demand thermal bubble inkjet printing system comprising thermal inkjet (TIJ) printhead(s) 114. The TIJ printhead implements a thermal resistor ejection element in an ink chamber to vaporize ink and create bubbles that force ink or other fluid drops out of a nozzle 116. In other examples, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle 116.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104. Printhead assembly 102 and ink supply assembly 104 (including reservoir 120) may be housed together in a print cartridge or pen 200 (FIG. 2), as identified by the dashed line 105. In some examples, the ink supply assembly 104 may be separate from the printhead assembly 102 and may supply ink to the printhead assembly 102 through a fluid connection such as a supply tube (not shown).

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. During printing, the media transport assembly 108 advances the print media 118 through the print zone 122.

In some examples, an inkjet printhead assembly 102 is a scanning type printhead assembly that includes one printhead 114. As such, mounting assembly 106 includes a carriage for moving inkjet printhead assembly 102 relative to media transport assembly 108 to scan print media 118. In other examples, an inkjet printhead assembly 102 is a non-scanning type printhead assembly with multiple printheads 114, such as a page wide array (PWA) print bar, or carrier. In such implementations, a PWA printbar may support multiple printhead assemblies 102 carrying multiple printheads 114. A PWA printbar also typically provides electrical communication between the printheads 114 and electronic controller 110, and provides fluidic communication between the printheads 114 and the ink supply assembly 104.

Electronic controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

Electronic controller 110 provides control of printhead assembly 102, including timing control for ejection of ink drops through printhead nozzles 116. In so doing, electronic controller 110 defines a pattern of ejected ink drops that form characters, symbols, and/or other graphics or images on print media 118. Timing control and, therefore, the pattern of ejected ink drops, is determined by the print job commands and/or command parameters. In one example, logic and drive circuitry forming a portion of electronic controller 110 are located on printhead assembly 102. In another example, logic and drive circuitry forming a portion of electronic controller 20 are located off printhead assembly 102.

Figure 2:
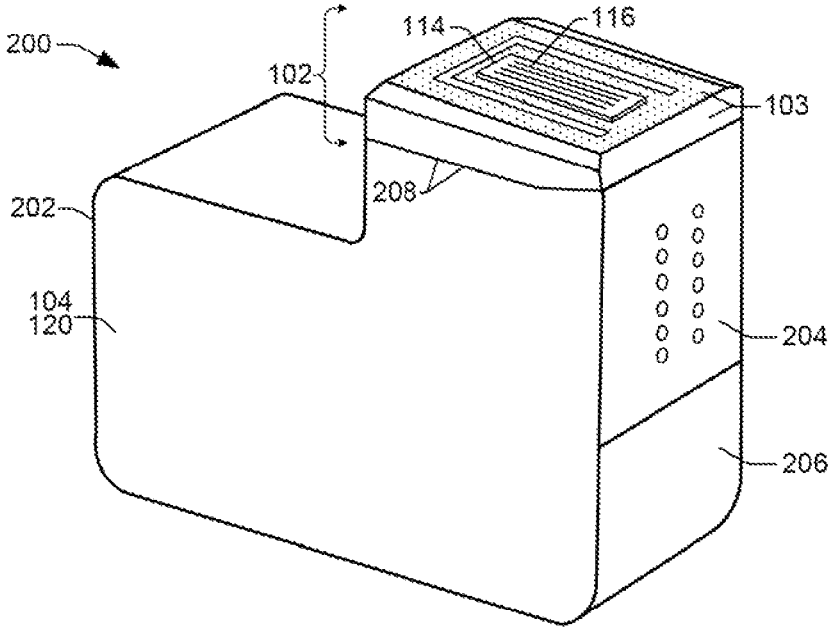
FIG. 2 shows a perspective view of an example print cartridge that includes a printhead assembly and fluid supply assembly.

Referring now to FIG. 2, an example print cartridge 200 is shown in a perspective view. The print cartridge 200 includes a printhead assembly 102 and a printing fluid supply in the form of ink supply assembly 104, as indicated by the dashed line 105 of FIG. 1. The printhead assembly 102 and ink supply assembly 104 are coupled or joined together to form print cartridge 200. Thus, the print cartridge 200 includes a body or housing 202 that supports printhead assembly 102 and contains the reservoir 120 (FIG. 1) of ink supply assembly 104. Reservoir 120 communicates with printhead assembly 102 to supply ink to printhead assembly 102. In other examples, the housing 202 may receive fluid from a remote fluid supply.

Figure 3:
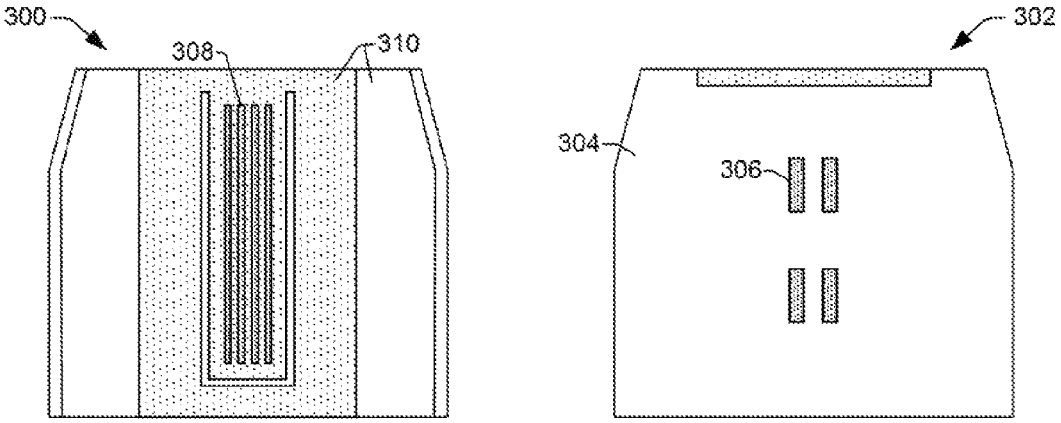
FIG. 3 shows a top down view and a bottom up view of an example one-piece printhead support.

Printhead assembly 102 is a modular assembly formed of components that include a molded, one-piece printhead support 103 and one or more printhead die 114. Printhead assembly 102 may also include additional components not shown, such as a manifold and one or more adhesive layers. The one-piece printhead support 103 provides mechanical support for the printhead die 114 and facilitates the routing and distribution of fluid to the die 114 from the ink supply assembly 104 reservoir 120 within housing 202. FIG. 3 shows a top down view 300 and a bottom up view 302 of an example one-piece printhead support 103. Referring to FIGS. 2 and 3, the one-piece printhead support 103 is secured to or mounted on housing 202 so as to provide a fluid-tight seal with housing 202. In one example, the one-piece printhead support 103 is adhered to the housing 202 of print cartridge 200 by applying an adhesive to the bottom side surface 304 of the printhead support 103, and/or to the top side surface 208 (not specifically shown) of the housing 202. Other attachment methods providing a fluid-tight seal between the printhead support 103 and housing 202 may also be used.

In one example, the housing 202 includes multiple isolated internal chambers (collectively referred to as reservoir 120) for supplying different fluids to one or more printheads 114. When the one-piece printhead support 103 is attached to the housing 202, the internal chambers (not shown) of reservoir 120 within housing 202 are placed in fluid communication with fluid inlets 306 at the bottom side surface 304 of the one-piece printhead support 103. Each of the fluid inlets 306 at the bottom-side surface 304 of the one-piece printhead support 103 is in fluid communication with a corresponding fluidic channel 308 at the top-side surface 310 through the one-piece printhead support. Thus, ink of a first color may be supplied to a particular row of nozzles 116 on the printhead die 114, while ink of a second color may be supplied to another row of nozzles 116 on the printhead die 114, and so on. In other examples, ink of a first color may be supplied to one printhead die 114, while ink of a second color may be supplied to another printhead die.

As shown in FIG. 2, housing 202 also supports electrical circuit contacts 204 and other electrical circuitry and/or conductive pathways (not shown), that facilitate communication of electrical signals between electronic controller 110 (FIG. 1) and printhead assembly 102 for controlling and/or monitoring operation of printhead assembly 102. Thus, the electrical contacts 204 facilitate communication of power, ground, and/or data signals to printhead assembly 102. In some examples, the electrical contacts 204 and circuitry may be supported by the print cartridge 200 along a side 206 of housing 202 of print cartridge 200. The electrical contacts 204 and circuitry may comprise a flexible electrical circuit formed in one or more layers of a flexible material such as polyimide or other polymer material, with conductive pathways formed of copper, gold, or other conductive material.

Figure 4:
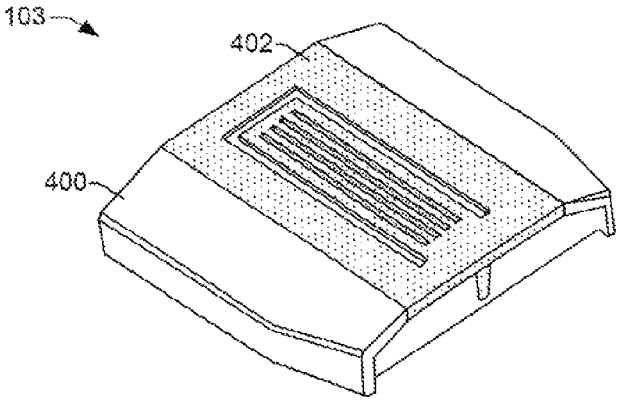
FIG. 4 shows a perspective view of an example of a molded, one-piece printhead support.

FIG. 4 shows a perspective view of an example of a molded, one-piece printhead support 103. As shown in FIG. 4, the one-piece printhead support 103 comprises a base portion 400 and a chiclet portion 402. The one-piece printhead support 103 is typically formed of a plastic material comprising one or more different polymers. The base portion 400 and chiclet portion 402 of the support 103 may each be formed of a different type and color of plastic/polymer material. Thus, the base portion 400 and chiclet portion 402 may have different colors as well as having different material and mechanical properties, such as different strength, elasticity, melting point, coefficient of thermal expansion (CTE), and so on. However, while the two materials may have such differences, they are nevertheless chemically compatible enough to induce permanent bonding in a two-shot molding process.

Figure 5:
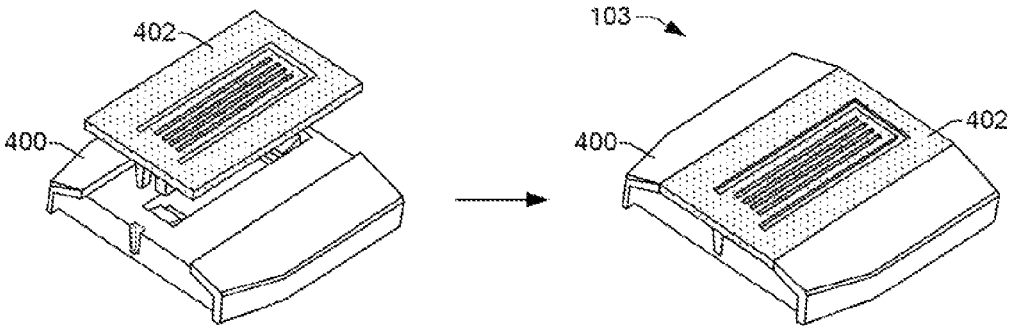
FIG. 5 shows an example of a base portion and the chiclet portion of a one-piece printhead support.

The one-piece printhead support 103 is formed in a common two-shot molding process that permanently fuses the base portion 400 and chiclet portion 402 into a single, inseparable component. FIG. 5 shows an example of how the base portion 400 and the chiclet portion 402 generally fit together. However, the illustration of FIG. 5 is not intended to indicate that the one-piece printhead support 103 is formed by joining two distinct components together. Indeed, in the present examples the base portion 400 and the chiclet portion 402 are not formed as, nor do they exist as, distinct components. Rather, a two-shot molding process uses a single metal mold having two different cavities to form the one-piece printhead support 103. In one example of a two-shot molding process, an initial step typically includes filling a first cavity of the mold with a first molding material. Thus, to form a one-piece printhead support 103, an initial step may include filling a first mold cavity shaped as the base portion 400 with a first melted plastic from a first injection unit. A next step in the molding process may then include filling a second mold cavity shaped as the chiclet portion 402 with a second melted plastic from a second injection unit. Once the metal mold cools, the one-piece printhead support 103 can be removed or ejected from the mold as a single component.

Figure 6:
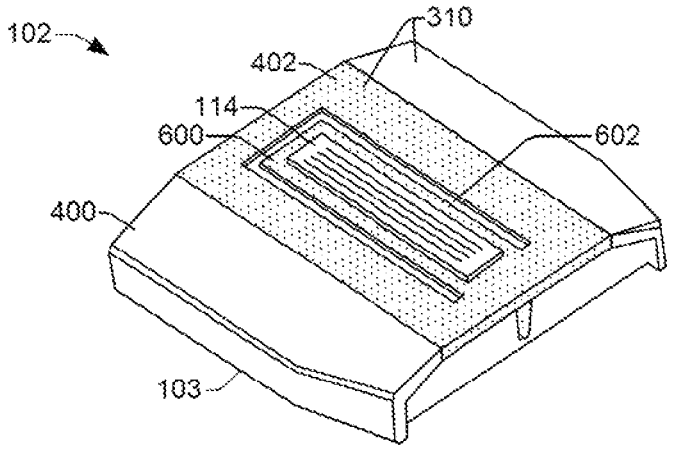
FIG. 6 shows a perspective view of an example printhead assembly with a printhead die adhered to a molded, one-piece printhead support having a three-sided trench.
Figure 7:
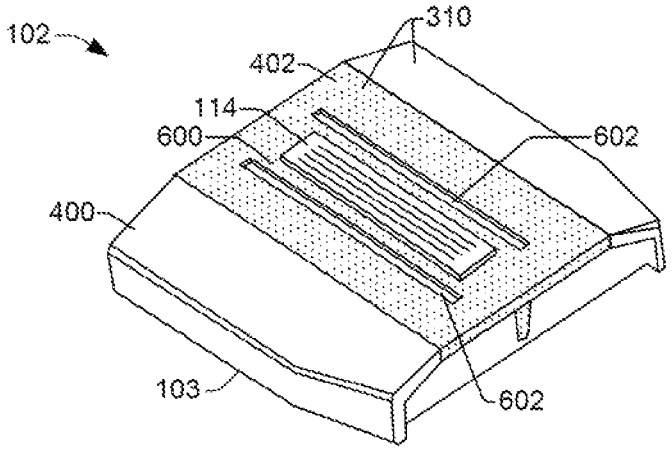
FIG. 7 shows an example of a printhead support having a two-sided trench.
Figure 8:
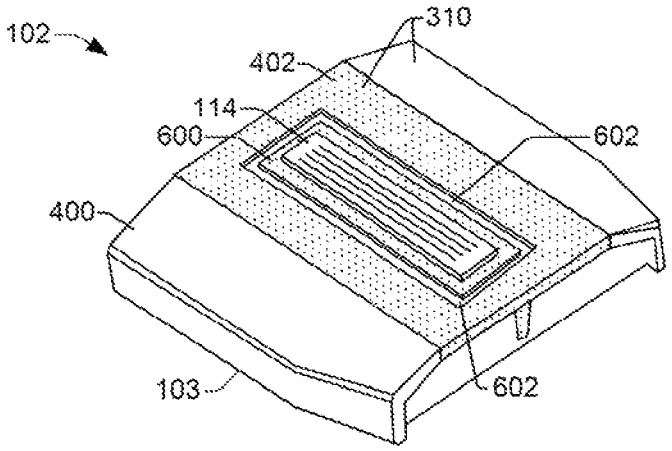
FIG. 8 shows an example of a printhead support having a four-sided trench.

FIG. 6 shows a perspective view of an example printhead assembly 102 with a printhead die 114 adhered to a molded, one-piece printhead support 103 that comprises a single component having a base portion 400 and a chiclet portion 402. The printhead die 114 is adhered to an area of the printhead support 103 referred to as the head-land surface area 600. The head-land area 600 is a planar surface area on the top side surface 310 (FIG. 3) of the chiclet portion 402 of support 103 that includes fluidic channels 308 (FIG. 3) through which fluid ink flows to the printhead die 114. As is apparent from FIG. 6, as well as from FIGS. 2-5, the printhead support 103 comprises a trench 602 formed in the chiclet portion 402 that partially surrounds the head-land surface area 600. In the examples shown in FIGS. 2-6, the trench 602 comprises a three-sided trench 602 having trench gaps or spaces formed in the chiclet portion 402 on three sides of the head-land surface area 600, resulting in a peninsular-shaped head-land area 600. However, in other examples, the trench 602 may comprise a two-sided trench having trench gaps or spaces formed in the chiclet portion 402 on two sides of the head-land surface area 600. FIG. 7 shows an example of a printhead support 103 having a two-sided trench 602 with the trench gaps or spaces in the chiclet portion 402 running along the elongated sides of the head-land surface area 600. In further examples, the trench 602 may comprise a four-sided trench having trench gaps or spaces formed in the chiclet portion 402 around all four sides of the head-land surface area 600. FIG. 8 shows an example of a printhead support 103 having a four-sided trench 602 with the trench gaps or spaces in the chiclet portion 402 running along all four sides of the head-land surface area 600.

In general, while the trench 602 is shown as having a partially rectangular shape, in some examples the trench 602 may take on different shapes such as a curved shape. In one example, the trench 602 extends into the surface of printhead support 103 from the top side surface 310 through the chiclet portion 402, to the underlying base portion 400. In other examples, however, the trench 602 may extend further into the printhead support 103 such that it extends into the base portion 400, or it may not extend far enough to reach the base portion 400. As noted above, the trench 602 serves as a buffer zone or space barrier around the head-land area 600 and the printhead die 114. The trench gaps or empty spaces of the trench 602 that are formed in the chiclet portion 402 between the head-land surface area 600 and the surrounding planar area of the printhead support 103, reduces mechanical stress in the head-land area generally caused by material expansion and contraction of the one-piece printhead support during temperature excursions. The reduction in mechanical stress over the head-land surface area 600 helps prevent cracks in the attached printhead die 114.

What is claimed is:

1. A print cartridge comprising:
a housing;
a one-piece printhead support attached to the housing;
a printhead supported on a head-land surface area; and
a trench in the printhead support surrounding the head-land surface area on at least two sides.

2. The print cartridge of claim 1, wherein the printhead support comprises:
fluid channels in the head-land surface area to supply fluid to the printhead; and
fluid inlets fluidically coupled with the fluid channels through the printhead support.

3. The print cartridge of claim 2, wherein the printhead support is attached to a first side of the housing, and the fluid inlets are on a second side of the housing, the second side different from the first side.

4. The print cartridge of claim 1, further comprising a fluid reservoir within the housing, the fluid reservoir in fluid communication with the fluid inlets.

5. The print cartridge of claim 4, wherein the fluid reservoir comprises a plurality of isolated chambers.

6. The print cartridge of claim 1, wherein the printhead comprises a printhead die.

7. The print cartridge of claim 1, wherein the trench is selected from the group consisting of a two-sided trench that surrounds the head-land surface area on two sides, a three-sided trench that surrounds the head-land surface area on three sides, and a four-sided trench that surrounds the head-land surface area on four sides.

8. The print cartridge of claim 1, wherein the trench comprises a three-sided trench that surrounds the head-land surface area on three sides forming a peninsular-shaped head-land surface area.

9. The print cartridge of claim 1, wherein the one-piece printhead support comprises a chiclet portion molded to a base portion in a two-shot molding process.

10. The print cartridge of claim 9, wherein the trench extends into the one-piece printhead support from a top side surface through the chiclet portion to the base portion.

11. A print cartridge comprising:
a housing;
a one-piece printhead support having a chiclet portion and a base portion molded together in a two-shot molding process;
a peninsular-shaped head-land area on the chiclet portion; and
a printhead die supported on the head-land area.

12. The print cartridge of claim 11, further comprising a trench in the chiclet portion surrounding the head-land area on three sides.

13. The print cartridge of claim 11, wherein the printhead die includes a first row of nozzles and a second row of nozzles, and wherein the printhead support comprises:
fluid channels in the head-land area to supply fluid to the printhead die.

14. The print cartridge of claim 13, further comprising:
a fluid reservoir within the housing, the fluid reservoir including a first isolated chamber to supply fluid of a first color to the first row of nozzles of the printhead, and the fluid reservoir including a second isolated chamber to supply fluid of a second color to the second row of nozzles of the printhead die.

15. The print cartridge of claim 14, wherein the printhead support comprises:
fluid inlets fluidically coupled with the fluid channels through the printhead support and in fluid communication with the fluid reservoir.

16. A method of forming a print cartridge, comprising:
using a molding process, forming a chiclet portion and a base portion as a single component that forms a one-piece printhead support, the base portion comprising a fluid path extending from a fluid inlet on a first side of the base portion to a fluidic channel of a head-land area on a second side of the base portion;
mounting a printhead die on the head-land area; and
attaching the one-piece printhead support to a housing of the print cartridge.

17. The method of claim 16, further comprising:
forming a trench in the printhead support, the trench surrounding the head-land area on at least two sides.

18. The method of claim 16, wherein the molding process uses a single mold having two different cavities to respectively form the base portion and the chiclet portion.

19. The method of claim 18, wherein the molding process fills a first cavity of the two different cavities with a first melted material for the base portion, and fills a second cavity of the two different cavities with a second melted material for the chiclet portion.

20. The method of claim 16, wherein the hl let portion has a surface that slants away from the base portion.

* * * * *